United States Patent [19]

Harry

[11] 4,140,634

[45] Feb. 20, 1979

[54] SWIMMING POOL SKIMMER SHIELD

[76] Inventor: Jack R. Harry, 3209 Drexel Ct., Oklahoma City, Okla. 73107

[21] Appl. No.: 745,006

[22] Filed: Nov. 26, 1976

[51] Int. Cl.[2] ..... E04H 3/16

[52] U.S. Cl. ..... 210/169; 15/1.7

[58] Field of Search ..... 210/169; 4/172.15, 172.17, 4/172.18; 15/1.7

[56] References Cited

U.S. PATENT DOCUMENTS

| | | | |
|---|---|---|---|
| 2,367,997 | 1/1945 | Chambers | 4/172.15 |
| 3,152,076 | 10/1964 | Kreutzer | 210/169 |
| 3,220,037 | 11/1965 | Ruhling | 15/1.7 |
| 3,625,364 | 12/1971 | La Chance | 210/169 |
| 3,770,128 | 11/1973 | Kast | 210/169 |
| 3,774,767 | 11/1973 | Field | 210/169 |
| 3,863,237 | 1/1975 | Doerr | 15/1.7 |
| 4,003,100 | 1/1977 | Whitaker | 15/1.7 |
| 4,053,412 | 10/1977 | Stix | 210/169 |

*Primary Examiner*—Theodore A. Granger

*Attorney, Agent, or Firm*—Laney, Dougherty, Hessin & Beavers

[57] ABSTRACT

Apparatus for shielding the skimmer mouth in the wall of a swimming pool to prevent the introduction of floating debris from the water surface through the skimmer mouth into the existing water filtration system of the swimming pool. The skimmer shield apparatus comprises a rigid wire support frame from which a formaminous baffle is supported shielding the entrance to the skimmer mouth. Also supported from the support frame is a preferably foraminous receptacle disposed beneath the baffle for receiving and collecting waterlogged floating debris engaged by the baffle to facilitate removal of such debris from the pool.

7 Claims, 11 Drawing Figures

SWIMMING POOL SKIMMER SHIELD

BACKGROUND OF THE INVENTION

1. Field of the Invention

This invention relates generally to improvements in swimming pool filtration systems, and more particularly, but not by way of limitation, to apparatus for preventing the introduction of floating debris from the water surface into the filtration system and collecting such debris for removal from the pool.

2. Description of the Prior Art

Conventional swimming pool filtration systems employ a water pickup generally known as a skimmer mouth in a swimming pool wall at the desired level of the water surface. Water from the water surface flows through the skimmer mouth to the suction side of a water circulation pump via a relatively small skimmer basket mounted near the skimmer mouth and usually accessible through an access way in the walkway surrounding the swimming pool. The water from the circulation pump is directed through appropriate filtration apparatus and is returned to the swimming pool via nozzles located in the pool wall and directed in such a manner as to induce water currents in the direction of the skimmer mouth.

Since it is desirable in many cases to maintain water in swimming pools the year around, it becomes readily apparent that in the autumn of the year leaves will fall or be blown into the swimming pool in large quantities which will swiftly clog the existing skimmer basket between the skimmer mouth and the suction side of the water circulation pump. Unless the basket is emptied frequently, in many cases necessitating emptying the basket a number of times each day, leaves and other floating debris will quickly clog the basket and prevent water from reaching the pump, thus often causing the circulation pump to burn out.

SUMMARY OF THE INVENTION

The present invention contemplates apparatus for use in a swimming pool or the like, having a skimmer mouth formed in the wall thereof adjacent the water surface, for shielding the skimmer mouth from floating debris on the water surface. The apparatus includes a support frame positionable within the pool adjacent the skimmer mouth. Further included are means for securing the support frame to the pool adjacent the skimmer mouth. The support frame carries baffle means which extends a distance above and a distance below the water surface and is positioned at least partially across the skimmer mouth for engaging floating debris on the water surface and shielding the skimmer mouth from the debris so engaged. The support frame also suspends receptacle means therefrom a distance below the water surface and beneath the baffle means for collecting debris engaged by the baffle means when the debris sinks below the water surface.

An object of the invention is to increase the efficiency of circulation systems for swimming pools or the like.

Another object of the invention is to provide means for collecting floating debris on the water surface of a swimming pool or the like for removal therefrom.

A further object of the invention is to provide apparatus for use in a swimming pool or the like for shielding the skimmer mouth of the water filtration system from floating debris on the water surface.

A still further object of the invention is to provide apparatus for use in a swimming pool or the like for shielding the skimmer mouth and protecting the water filtration system from floating debris on the water surface and for collecting such debris so shielded which is economical in construction and simple in operation.

Other objects and advantages of the invention will be evidence from the following detailed description when read in conjunction with the accompanying drawings.

DESCRIPTION OF THE PREFERRED EMBODIMENTS

Figure 1A:
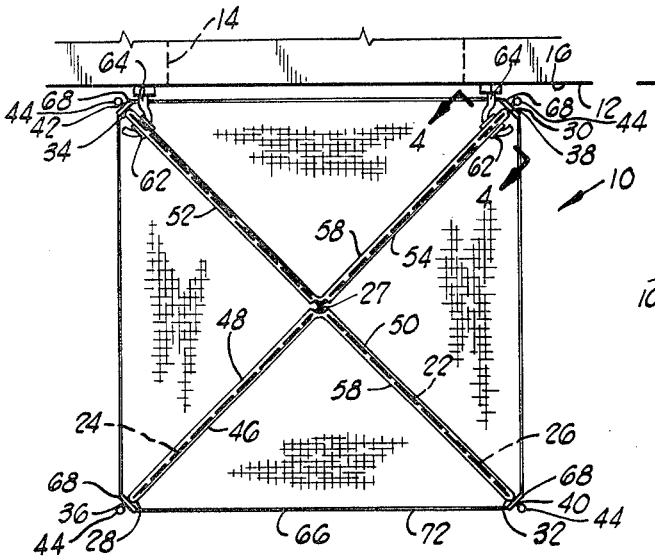
FIG. 1A is a top plan view of one form of swimming pool skimmer shield constructed in accordance with the present invention.
Figure 1B:
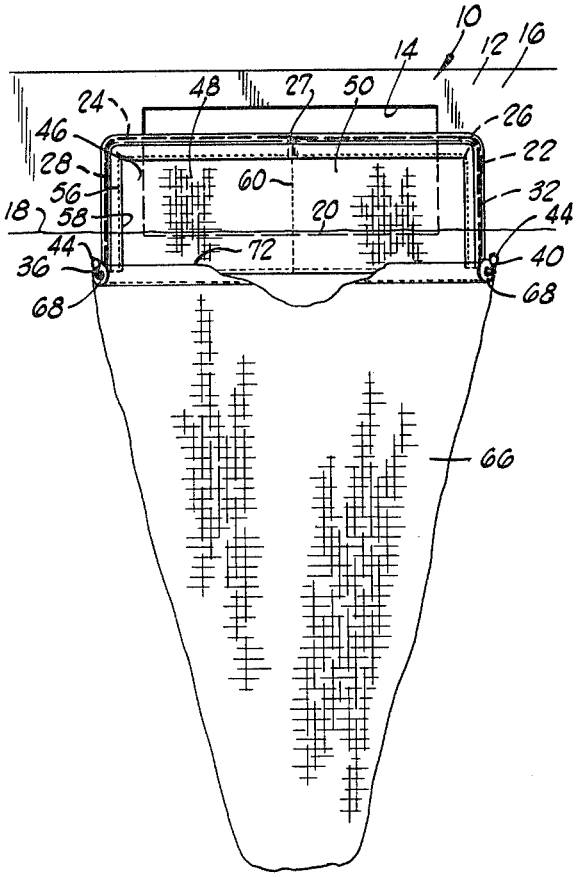
FIG. 1B is a front elevation view of the swimming pool skimmer shield of FIG. 1A.

Referring now to the drawings, and to FIGS. 1A and 1B in particular, a first form of swimming pool skimmer shield constructed in accordance with the present invention is illustrated therein and is generally designated by the reference character 10. The apparatus 10 is shown disposed within a swimming pool 12 having a conventional skimmer opening or mouth 14 formed in the wall 16 of the pool. It will be understood that the water surface 18 in the pool 12 is maintained at a level substantially above the lower edge 20 of the skimmer opening 14 so that as the pool water is circulated through a conventional filtration system (not shown), the water at the water surface flows over the lower edge 20 where it is filtered and recirculated into the pool through one or more appropriate nozzles (not shown).

While the conventional swimming pool skimmer and filtration apparatus includes a skimmer basket in the skimmer throat just downstream from the skimmer mouth 14 to prevent the introduction of debris into the circulation system, such baskets are relatively small and are subject to blockage in a very short time when leaves and various forms of seeds from surrounding trees and shrubs fall into the swimming pool. When the basket is so blocked by leaves, seeds and other floating debris, it is imperative that the basket be emptied immediately to prevent the circulation pump from being burned up for lack of water on the suction side thereof.

The swimming pool skimmer shield apparatus 10 is installed adjacent the skimmer mouth 14 and provides means for shielding or masking the skimmer mouth 14 from the introduction of floating debris thereto and further provides means for collecting such debris when it becomes waterlogged and sinks below the water surface 18.

The apparatus 10 includes a support frame 22 positionable within the pool 12 adjacent the skimmer opening or mouth 14. The support frame 22 is suitably constructed of first and second relatively rigid stainless steel wire members 24 and 26 which are fixedly secured at their medial portions by suitable means such as a resistance weld as indicated at 27. The wire members 24 and 26 are secured together in substantially normal relation and define a substantially horizontal plane. The opposite end portions 28 and 30 of wire member 24 and the opposite end portions 32 and 34 of wire member 26 extend downwardly and in normal relation to the plane defined by the wire members 24 and 26. The lower end of each downwardly extending end portion 28, 30, 32 and 34 terminates in a respective upwardly opening hook 36, 38, 40 and 42. The end of each hook 36, 38, 40 and 42 is preferably received in a protective synthetic resin tip or cap 44 which may be suitably formed of vinyl. The stainless steel wire employed in the construction of the wire members 24 and 26 preferably has a diameter of approximately 3/16 inch or No. 6 AWG.

Figure 4:
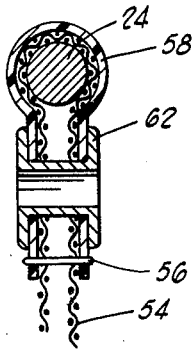
FIG. 4 is an enlarged cross-sectional view taken along line 4—4 of FIG. 1A.

A foraminous baffle 46 is secured to the support frame 22 and includes four mutually intersecting vertical foraminous panels 48, 50, 52 and 54 each angularly spaced from the next adjacent panel at an angle of approximately 90° about a vertical line intersecting the point of mutual securement 27 between the first and second wire members 24 and 26. The panels 48 and 50 are preferably constructed of a single piece of nylon mesh fabric with the edges thereof folded over the wire members 24 and 26 intermediate the point of connection 27 and the hooks 36 and 40 of the end portions 28 and 32, respectively. Similarly, the panels 52 and 54 are also formed of a single piece of nylon mesh fabric with the edges thereof folded over the wire members 24 and 26 intermediate the point of mutual interconnection 27 and the hooks 38 and 42 of the end portions 30 and 34, respectively. The folded edges of the panels 48 and 50 and the folded edges of the panels 52 and 54 are secured about the wire members 24 and 26 by means of suitable stitching as shown at 56. The stitching 56 is preferably applied to a relatively flexible binding 58 formed of a suitable material such as vinyl which is positioned over the wire members 24 and 26 directly over the folded mesh fabric to provide reinforcement for the stitching 56. This structure is most clearly shown in FIG. 4. It has been found that a suitable mesh fabric for this purpose has openings of approximately 3/16 inch diameter and the fabric is preferably woven of nylon. The mesh fabric piece forming the panels 48 and 50 and the mesh fabric piece forming the panels 52 and 54 are preferably stitched together as shown at 60 thus forming a vertical line of intersection among the panels 48, 50, 52 and 54 intersecting the point of interconnection 27 between the wire members 24 and 26.

Conventional grommets 62, suitably formed of brass, are inserted through the binding 58 adjacent the uppermost portion of the end portions 30 and 34 of the wire members 24 and 26. Each grommet 62 is sized to receive the outer end of a corresponding one of a pair of hooks 64 extending outwardly from the pool wall 16 on each side of the skimmer opening or mouth 14 as best shown in FIG. 1A. The end portions 28, 30, 32 and 34 of the wire members 24 and 26 are preferably approximately eight inches in height and hooks 64 are so positioned on the pool wall 16 as to place the hooks 36, 38, 40 and 42 and the lower edges of the panels 48, 50, 52 and 54 a distance of approximately three to four inches below the water surface 18 and the lower edge 20 of the skimmer mouth 14.

The skimmer shield 10 further includes a receptacle 66 preferably in the form of a foraminous bag, suitably constructed of open mesh fabric having closed side portions, a closed bottom portion and an open top portion, with the open top portion having four grommets 68 mounted therealong at spaced points and receivable over the respective hooks 36, 38, 40 and 42 of the support frame 22 to thereby suspend the receptacle 66 beneath the baffle 46.

Figure 6:
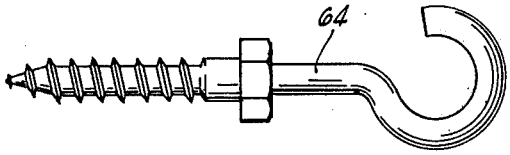
FIG. 6 is a side elevation view of a masonry bolt having a hook formed on the outer end thereof for securing the skimmer shield of the present invention to a swimming pool wall.
Figure 8:
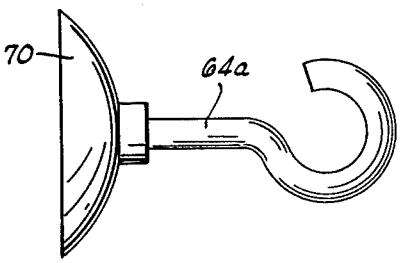
FIG. 8 is a side elevation view of a protuberance having a hook formed on the outer end thereof and a suction cup mounted on the opposite end thereof for securing the skimmer shield of the present invention to a swimming pool wall.

FIG. 6 illustrates a suitable form of hook 64, preferably constructed of stainless steel and having threads thereon, for securing the hook 64 in a masonry pool wall. FIG. 8 illustrates an alternate form of hook designated as **64*a*, the metallic portions thereof preferably formed of stainless steel and having a rubber or synthetic resin suction cup 70 mounted on one end, to permit the securement of the hook 64*a* to the exterior surface of a pool wall 16 of the type which has a vinyl liner formed on the surface thereof, or such other type of pool wall unsuitable for installation of the threaded hook 64**.

It will be seen that as water from the swimming pool is circulated to the skimmer mouth 14 for recirculation through the filtration system, floating debris in the pool will be engaged by the baffle 46 of the swimming pool skimmer shield 10 thus preventing the introduction of such debris into the skimmer basket disposed inside the skimmer throat. As the debris so engaged by the baffle 46 becomes waterlogged and thus loses its buoyancy, the debris will fall downwardly from the baffle 46 through the open upper end portion 72 of the receptacle 66 where such debris can be conveniently collected for periodic removal from the swimming pool. The support frame 22 and the receptacle 66 can be readily removed from the swimming pool by disengaging the grommets 62 from the hooks 64 and lifting the entire swimming pool skimmer shield structure 10 from the water. The receptacle 66 can then be readily disengaged from the hooks 36, 38, 40 and 42 to permit the contents thereof to be dumped in a suitable collection area. The swimming pool skimmer shield 10 can also be conveniently removed from the pool when swimming activities are in progress so that the shield 10 will not interfere with the use of the pool.

It will be understood that the swimming pool skimmer shield 10 will be quite advantageously employed during the autumn of the year when swimming activities have ceased but it is desirable to maintain water in the pool on a year round basis. The shield 10 will greatly facilitate the collection of fallen leaves which inevitably find their way into the open swimming pool in great numbers during this season of the year.

Figure 2A:
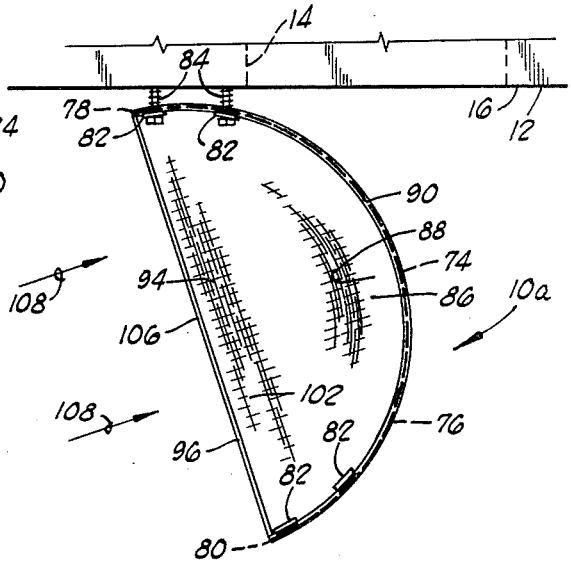
FIG. 2A is a top plan view of a second form of swimming pool skimmer shield constructed in accordance with the present invention.
Figure 2B:
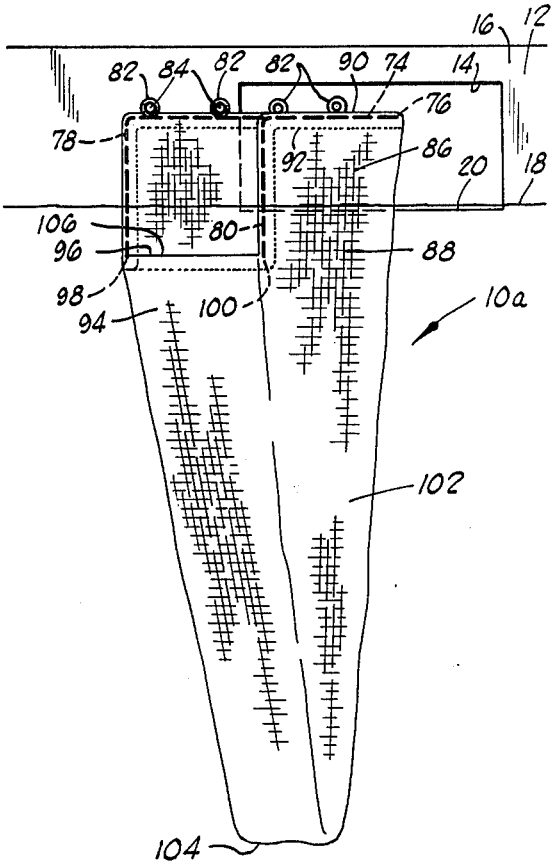
FIG. 2B is a front elevation view of the swimming pool skimmer shield of FIG. 2A.

A second form of swimming pool skimmer shield is illustrated in FIGS. 2A and 2B and is generally designated by the reference character 10a. The skimmer shield 10a is shown disposed within a swimming pool 12 adjacent the skimmer mouth 14 formed in the wall 16 thereof. The water surface 18 in the pool is substantially above the lower edge 20 of the skimmer mouth 14.

The skimmer shield 10a comprises a support frame 74 positionable within the pool 12 adjacent the skimmer mouth 14. The frame includes a substantially C-shaped, relatively rigid stainless steel wire member 76 defining a substantially horizontal plane with the opposite end portions 78 and 80 extending downwardly in normal relation to the horizontal plane defined by the C-shaped portion of the wire member 76. The end portions 78 and 80 extend downwardly a vertical distance of approximately eight inches. Two stainless steel washers 82, each having an aperture formed therein, are fixedly secured to the C-shaped portion of the wire member 76 adjacent the end portion 78. Similarly, two additional washers 82 are fixedly secured to the wire member 76 adjacent the end portion 80. The washers 82 may be suitably secured to the wire member 76 by means of resistance welding.

The support frame 74 is preferably secured to the wall 16 of the pool 12 adjacent one side of the skimmer opening or mouth 14 by means of a pair of hex-headed masonry bolts 84 which extend outwardly from the wall 16 of the pool. The enlarged hex-heads of the bolts 84 are sized to be received through the apertures of the corresponding washers 82 adjacent the end portion 78 to releasably secure the support frame 74 to the pool wall 16 as shown in FIGS. 2A and 2B, with the lower ends of the end portion 78 and 80 preferably extending a distance of approximately three to four inches below the water surface 18 while the C-shaped portion of the wire member 76 is positioned a distance above the water surface 18 in a plane substantially parallel thereto.

A foraminous baffle 86 in the form of a piece of open mesh fabric 88 is secured along the wire member 76 and the opposite end portions 78 and 80 thereof by folding the upper edge 90 of the fabric piece 88 over the wire member 76 and end portions 78 and 80 and stitching the fabric piece thereto as indicated at 92. The mesh fabric piece 88 is preferably woven of nylon thread or cord and the openings therein are preferably approximately 3/16 inch in diameter.

A foraminous panel 94 extends at its upper edge 96 horizontally between the lower ends 98 and 100 of the end portions 78 and 80 of the wire member 76 a distance of approximately 28 inches, and extends downwardly therefrom. The foraminous panel 94 and the foraminous baffle 86 are joined together by suitable means, such as stitching or by mutual interweaving, to form a receptacle 102 having closed side portions and a closed bottom portion 104 and an open top portion 106 defined by the upper edge 96 of the panel 94 and the upper edge of the baffle 86 at its connection along the wire member 76.

It will be understood that the upper edge 96 of the foraminous panel 94 is positioned approximately three to four inches below the water surface 18 while the foraminous baffle 86 extends a distance of approximately four to five inches above the water surface 18. The positioning of the skimmer shield 10a as shown in FIGS. 2A and 2B partially shields or masks the skimmer mouth 14 from the introduction of floating debris on the water surface 18 thereto. The skimmer shield 10a is preferably utilized in swimming pools wherein the nozzles (not shown) introducing filtered water back into the pool 12 induce water circulation at the surface in the general direction indicated by the arrows 108. It will be seen that as water is so circulated in the swimming pool, floating debris on the water surface will be engaged by the baffle 86 of the skimmer shield 10a thus preventing the introduction of such debris into the skimmer basket disposed inside the skimmer throat. As the debris so engaged by the baffle 86 becomes waterlogged and thus loses its buoyancy, the debris will fall downwardly from the baffle 86 through the open top portion 106 of the receptacle 102 where such debris can be conveniently collected for periodic removal from the swimming pool. The support frame 74, the baffle 86 and the receptacle 102 can be readily removed from the swimming pool by disengaging the washers 82 from the enlarged heads of the bolts 84 and then lifting the entire skimmer shield structure 10a from the water. The support frame 74 and the receptacle 102 can then be inverted to dump the contents thereof in a suitable collection area. The skimmer shield 10a can also be removed from the pool when swimming activities are in progress so that the shield will not interfere with the intended use of the pool.

Figure 5:
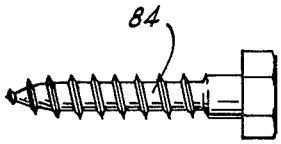
FIG. 5 is a side elevation view of one form of hex headed masonry bolt for securing the skimmer shield of the present invention to a swimming pool wall.
Figure 7:
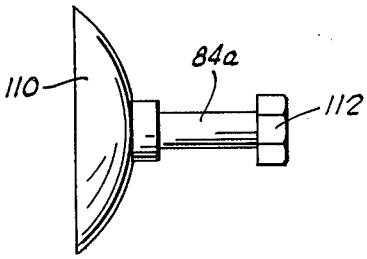
FIG. 7 is a side elevation view of a hex-headed protuberance having a suction cup mounted on the opposite end thereof for securing the skimmer shield of the present invention to a swimming pool wall.

FIG. 5 illustrates a suitable form of masonry bolt or protuberance 84, preferably formed of stainless steel and having threads thereon, for securing the bolt 84 in a masonry pool wall. FIG. 7 illustrates an alternate form of mounting protuberance designated as 84a, having a rubber or synthetic resin suction cup 110 mounted on one end, to permit the securement of the protuberance 84a to the exterior surface of a pool wall 16 of the type which has a vinyl liner formed thereon, or such other type of pool wall unsuitable for installation of the threaded bolt 84. The protuberance 84a is equipped with an enlargement 112, in this case having a hexagonal shape, on the end thereof opposite the suction cup 110. The enlargement 112 is sized to be received through a corresponding aperture in a washer 82 on the wire member 76. The metallic parts of the protuberance 84a are preferably formed of stainless steel.

It will be understood that the bolts 84 may be installed on the opposite side of the skimmer mouth 14 from that illustrated in the drawings and the support frame 74 may be secured thereto by positioning the washers 82 adjacent the end portion 80 of the wire member 76 about the heads of the bolts 84. Thus, the skimmer shield 10a is susceptible to proper installation adjacent the skimmer mouth 14 of the swimming pool 12 of any swimming pool regardless of the direction of water flow induced by the water nozzles.

It should also be noted that the foraminous panel 94 may be formed of the same open mesh fabric as that described above for the foraminous baffle 86. It may prove desirable to form the baffle 86 and the panel 94 of a single piece of open mesh fabric suitably stitched to close the sides and bottom to achieve the configuration illustrated in FIGS. 2A and 2B.

Figure 3A:
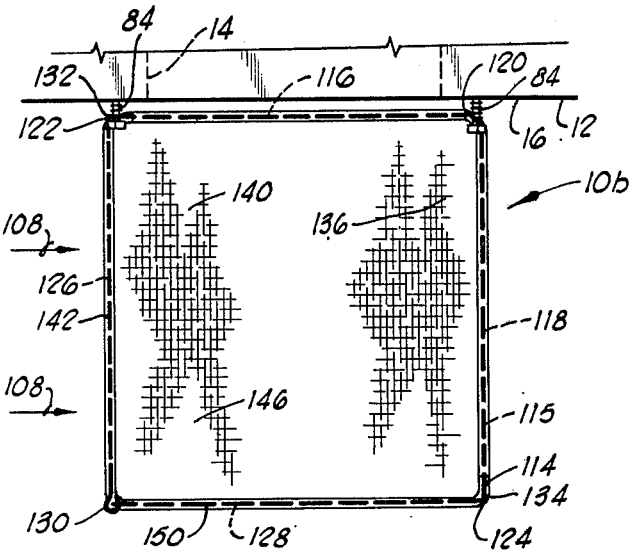
FIG. 3A is a top plan view of a third form of swimming pool skimmer shield constructed in accordance with the present invention.
Figure 3B:
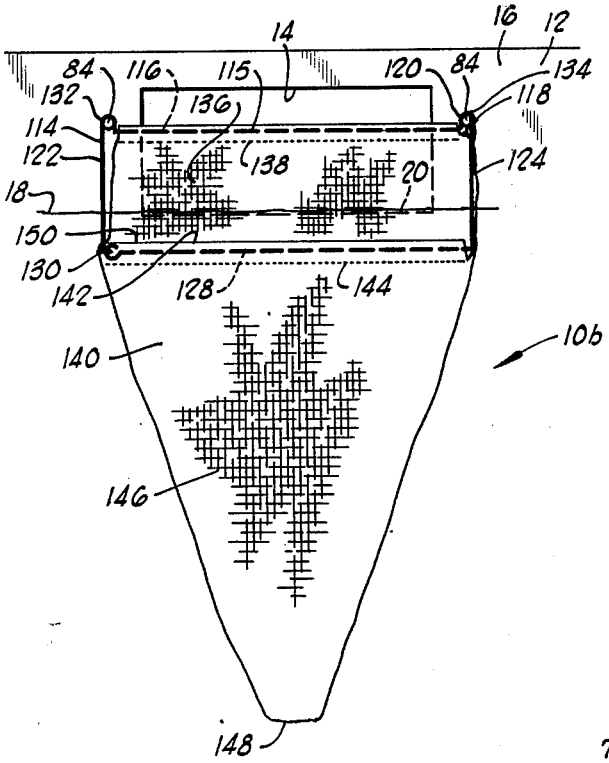
FIG. 3B is a front elevation view of the swimming pool skimmer shield of FIG. 3A.

A third form of swimming pool skimmer shield is illustrated in FIGS. 3A and 3B and is generally designated by the reference character 10b. The apparatus 10b is shown disposed within a swimming pool 12 having a conventional skimmer opening or mouth 14 formed in the wall 16 of the pool. It will again be understood that the water surface 18 of the pool 12 is maintained at a level substantially above the lower edge 20 of the skimmer mouth 14 as described above.

The skimmer shield **10*b* includes a support frame 114 positionable within the pool 12 adjacent the skimmer mouth 14. The frame 114 includes a relatively rigid stainless steel wire member 115, preferably 3/16 inch in diameter, having a first pair of segments 116 and 118 mutually connected at the first ends thereof at an angle of approximately 90° as shown at 120, the segments 116 and 118 defining a first substantially horizontal plane positionable over the water surface 18. The support frame 114 includes a second pair of segments 122 and 124 each connected at the first end thereof to the corresponding second end of each of the segments 116 and 118, respectively, and extending downwardly therefrom. The support frame 114 further includes a third pair of segments 126 and 128 each connected at the first end thereof to the second end of each of the segments 122 and 124, respectively, and mutually connected at the second ends of the segments 126 and 128 at an angle of approximately 90° as shown at 130. The third pair of segments 126 and 128 define a second substantially horizontal plane spaced a vertical distance downwardly from the plane of the first pair of segments 116 and 118. It will be seen in FIG. 3A that the rigid wire member 115** forms a substantially rectangular closed structure when viewed from above.

At the connection 120 between segments 116 and 118 of the wire member 115, a loop, defining an aperture, is formed in the wire member 115 which is sized and shaped to receive the hexagonal head of a corresponding mounting bolt 84 therethrough to secure the wire member 115 to the pool wall 16. The enlarged hex-head of the bolt 84 is of sufficient size to engage the loop at 120 to provide releasable securement therebetween. A downwardly facing U-shaped detent 132 is formed in the wire member 115 at the interconnection between the segments 116 and 122. The detent 132 is sized and shaped to releasably engage a second mounting bolt 84 extending outwardly from the pool wall 16 from the opposite side of the skimmer mouth 14 from the previously described bolt 84. A second downwardly facing U-shaped detent 134, similar to the detent 132, is formed in the wire member 115 at the point of interconnection between the segments 118 and 124. The detent 134 is sized and shaped to releasably engage a bolt 84 in the event the skimmer shield **10*b*** is to be mounted in an alternative position to that illustrated in FIGS. 3A and 3B as will be described hereinafter.

A foraminous baffle 136 is preferably formed of an open mesh fabric such as woven nylon mesh having openings therein of approximately 3/16 inch diameter. The baffle 136 is secured along its upper edge to the segments 116 and 118 of the wire member 115 by folding the upper edge thereof over the segments 116 and 118 and stitching the folded portion to the body of the baffle as shown at 138. The baffle 136 extends downwardly from the segments 116 and 118 a distance substantially below the second substantially horizontal plane defined by the segments 126 and 128.

A foraminous panel 140, preferably formed of the same material as that used in forming the baffle 136, is secured at the top edge 142 thereof to the segments 126 and 128 of the wire member 115 by folding the top edge thereof over the segments 126 and 128 and stitching the folded portion to the body of the panel 140 as shown in 144, and extends downwardly therefrom. The foraminous panel 140 and the foraminous baffle 136 are suitably joined together below the wire member 115 to form a receptacle 146 having closed side portions, a closed bottom portion 148, and an open top portion 150 defined by the baffle 136 and the top edge 142 of the panel 140. The baffle 136 is a substantially vertical extension of one of the side portions of the receptacle 146.

The vertical distance between the plane defined by the segments 116 and 118 of the wire member 115 and the plane defined by the segments 126 and 128 is preferably approximately eight inches. The bolts 84 are preferably positioned on opposite sides of the skimmer mouth 14 at a height above the water surface 18 such that the segments 126 and 128 of the wire member 115 are positioned approximately three to four inches below the water surface 18. It will also be seen that a portion of the foraminous baffle 136 suspended from the wire segment 116 of the wire member 115 extends fully horizontally across the skimmer mouth 14 to completely block the opening thereto to the entry of any floating debris on the water surface. The portion of the foraminous baffle 136 suspended from the segment 118 of the wire member 115 extends outwardly from the pool wall 16 to catch any floating debris directed toward the baffle 136 in the direction indicated by the arrows 108 by the water currents induced by the water circulating nozzles (not shown).

It will be understood that the skimmer shield **10*b* is adapted to be positioned on the mounting bolts 84 with the wire segment 118 extending horizontally across the skimmer mouth 14 and with the wire segment 116 extending outwardly from the pool wall 16 when the direction of induced water currents in the pool 12 is in a direction opposite that indicated by the arrows 108. It should further be understood that, as with the skimmer shield 10*a*, the protuberances 84*a* may be substituted for the bolts 84 when the skimmer shield 10*b* is to be installed in a swimming pool having a vinyl liner formed on the wall 16 thereof or when the skimmer shield 10*b* is to be installed in a swimming pool having walls which are otherwise unsuitable for installation of the threaded bolts 84**.

As with the skimmer shield **10*a*, the skimmer shield 10*b* can be readily removed from the mounting bolts 84 or protuberances 84*a* in order to dump the accumulated debris from the receptacle 146 into a suitable collection area away from the swimming pool 12**.

From the foregoing it will be seen that the various forms of the swimming pool skimmer shields of the present invention provide useful, long needed, and as yet unavailable apparatus for use in conjunction with the existing skimmer structure of a swimming pool filtration system to prevent the clogging of the skimmer basket at the skimmer mouth with floating debris such as leaves, seed pods, bugs and the like which can often result in the burning out of the filtration system circulation pump when water can no longer be provided to the suction inlet thereof.

Changes may be made in the combination and arrangement of parts or elements as heretofore set forth in the specification and shown in the drawings without departing from the spirit and scope of the invention as defined in the following claims.

What is claimed is:

1. Apparatus for use in a swimming pool or the like having a skimmer mouth formed in a wall thereof adjacent the water surface, for shielding the mouth of the skimmer from floating debris on the water surface, comprising:

a support frame including first and second relatively rigid frame members mutually secured at their medial portions in substantially normal relation and defining a substantially horizontal plane, the opposite end portions of each frame member extending downwardly and in normal relation to said plane;

a foraminous baffle secured to said support frame and including four mutually intersecting vertical foraminous panels each angularly spaced from the next adjacent panel at an angle of approximately 90° about a vertical line intersecting the point of mutual securement between said first and second frame members;

a receptacle having closed side portions, a closed bottom portion and an open top portion and secured at spaced points along the open top portion to said support frame whereby said receptacle is suspended therebelow; and means engageable with said support frame for securing said support frame to the pool wall across the skimmer mouth with said baffle extending across the skimmer mouth.

2. The apparatus of claim 1 wherein the lower end of each downwardly extending end portion of the frame members comprises a hook formed thereon engaging said receptacle.

3. The apparatus as defined in claim 1 wherein said baffle and said receptacle are characterized further as each being formed of an open mesh fabric.

4. The apparatus as defined in claim 1 wherein said means for securing said support frame to the pool wall is characterized further to include:

a pair of hooks extending outwardly from the pool wall on opposite sides of the skimmer mouth; and a pair of apertures carried by said support frame in a pair of mutually adjacent vertical panels of said baffle, respectively, each sized and shaped to receive a corresponding one of said pair of hooks therethrough to thereby secure said support frame to the pool wall.

5. The apparatus as defined in claim 3 wherein each of said pair of hooks includes suction cup means mounted thereon for securing each of said hooks to the pool wall.

6. A swimming pool skimmer shield system, comprising:

a swimming pool having a skimmer mouth formed in a wall thereof;

a support frame positioned adjacent the skimmer mouth, said support frame including a relatively rigid wire member comprising:

a first pair of segments mutually connected at the first ends thereof at an angle of approximately 90° and defining a first substantially horizontal plane;

a second pair of segments each connected at the first end thereof to the second end of a respective one of said first pair of segments and extending downwardly therefrom; and a third pair of segments each connected at the first end thereof to the second end of a respective one of said second pair of segments and mutually connected at the second ends thereof at an angle of approximately 90°, said third pair of segments defining a second substantially horizontal plane spaced a vertical distance downwardly from the first substantially horizontal plane;

means for securing said support frame to the pool adjacent the skimmer mouth;

foraminous receptacle means having closed side portions, a closed bottom portion and an open top portion; and foraminous panel baffle means, carried by said support frame and extending a distance above and a distance below a lower edge of the skimmer mouth and positioned at least partially across the skimmer mouth for engaging floating debris and shielding the skimmer mouth from the debris so engaged, said baffle means being a substantially vertical extension of one of said side portions of said foraminous receptacle means, and said receptacle means being suspended from said support frame a distance below the lower edge of the skimmer mouth and beneath said baffle means for collecting debris engaged by said baffle means.

7. A swimming pool skimmer shield system, comprising:

a swimming pool having a skimmer mouth formed in a wall thereof;

a support frame positioned adjacent the skimmer mouth;

means for securing said support frame to the pool adjacent the skimmer mouth;

foraminous panel baffle means, including four mutually intersecting vertical foraminous panels each angularly spaced from the next adjacent panel at an angle of approximately 90° about a vertical axis, said baffle means being carried by said support frame and extending a distance above and a distance below a lower edge of the skimmer mouth and positioned at least partially across the skimmer mouth for engaging floating debris and shielding the skimmer mouth from the debris so engaged; and receptacle means, including closed side portions, a closed bottom portion and an open top portion, said receptacle means being suspended from said support frame a distance below the lower edge of the skimmer mouth and beneath said baffle means for collecting debris engaged by said baffle means.

* * * * *